United States Patent [19]

Reading

[11] 4,059,510

[45] Nov. 22, 1977

[54] MAGNETIC SEPARATORS

[75] Inventor: Hugh Thomas Reading, Goonellabah, Australia

[73] Assignee: Readings of Lismore Pty. Limited, Australia

[21] Appl. No.: 649,101

[22] Filed: Jan. 13, 1976

[30] Foreign Application Priority Data

Feb. 5, 1975 Australia ..... 0476/75

[51] Int. Cl.[2] ..... B03C 1/14

[52] U.S. Cl. ..... 209/223 A; 209/232

[58] Field of Search ..... 209/219, 220, 222, 232; 210/222, 223 R, 223 A, 214

[56] References Cited

U.S. PATENT DOCUMENTS

| | | | |
|---|---|---|---|
| 460,962 | 10/1891 | Gouyard | 209/219 |
| 823,492 | 6/1906 | Durham | 209/219 |
| 832,825 | 10/1906 | Wait | 209/222 |
| 2,763,204 | 9/1956 | Sims | 210/222 X |
| 2,834,470 | 5/1958 | Jones | 210/222 |
| 3,326,374 | 6/1967 | Jones | 209/232 X |
| 3,830,367 | 8/1974 | Stone | 209/222 |
| 3,849,301 | 11/1974 | Reading | 209/214 |
| 3,935,095 | 1/1976 | Susse | 209/222 |

FOREIGN PATENT DOCUMENTS

| | | | |
|---|---|---|---|
| 252,034 | 5/1976 | United Kingdom | 209/222 |

*Primary Examiner*—Robert Halper

*Attorney, Agent, or Firm*—Ladas, Parry, Von Gehr, Goldsmith & Deschamps

[57] ABSTRACT

A wet magnetic separator has a rotor formed on its periphery with a through annulus which is defined by two concentrically arranged non-magnetic walls and is divided into passages by radially-extending laminated spacer bars of a magnetic material. The rotor is surrounded by pole pieces which are energized in pairs to provide successive magnetic poles of opposite polarity around the rotor. The arrangement of the rotor and the magnetic poles is such that a magnetic field of maximum intensity is induced in the spacer bars when they are travelling between adjacent poles of opposite polarity.

8 Claims, 5 Drawing Figures

MAGNETIC SEPARATORS

FIELD OF THE INVENTION

This invention relates to apparatus for magnetically separating magnetic materials from non-magnetic materials contained in a slurry. More specifically the invention is concerned with a magnetic separator of the type disclosed in the applicant's issued U.S. Pat. No. 3,849,301.

STATE OF THE ART

In the above mentioned United States Patent is described apparatus for separating a slurry into its magnetic and non-magnetic constituents. The apparatus comprises a rotor having its axis vertical and providing a ring of upright parallel passages. The passages extend around a vertical annulus provided between two concentrically arranged non-magnetic cylinders made of stainless steel. The passages are separated from one another by radial walls formed by cast-steel spacer bars. These are ferro-magnetic. A ring of arcuately spaced pole pieces is arranged around the outside of the annulus and the pole pieces are of successively opposite polarity. A yoke of low magnetic reluctance is connected between the outsides of the pole pieces and the magnetic flux produced by them travels around a flux circuit which includes an annulur section of the rotor annulus. As the spacer bars travel through the annular section containing the magnetic flux they have their opposite faces magnetized in opposite senses. The magnetization of the opposite faces of each spacer bar is a maximum when it is travelling between adjacent poles of opposite polarity and a minimum when it is passing beneath a pole.

The slurry containing a mixture of magnetic and non-magnetic materials is allowed to flow down through the passages as the rotor rotates and the magnetic materials in the slurry are attracted to the radial walls of the passage when their magnetization is greatest. As the spacer bars are carried by the rotor alternately through regions of high and low magnetic flux, the non-magnetic materials tend to be selectively discharged from the lower ends of the passages when they are passing between the poles, and the magnetic materials are discharged when the spacer bar magnetism is least, that is to say when travelling past the poles.

OBJECT OF THE INVENTION

An object of the invention is to improve the operating performance of a magnetic separator while reducing its cost.

THE INVENTION

In accordance with the present invention apparatus for separating magnetic constituents from non-magnetic constituents of a liquid slurry, includes a rotor having two concentrically arranged, non-magnetic cylinders providing between then an annulus which is spanned by radially extending spacer bars of magnetic material which divide the annulus up into a ring of open-ended unobstructed through passages, in which rotor each spacer bar comprises a stack of parallel laminations rigidly held to one another and to the two non-magnetic cylinders, the laminations being shaped to provide each pair of spacer bars with opposed corrugations and the planes of the laminations extending parallel to the direction of movement of the spacer bars when the rotor is rotated.

The effect of laminating the spacer bars is to improve greatly the ability of the apparatus to separate magnetic constituents from non-magnetic constituents. This is a surprising result because it is normally considered uneconomic and unnecessary to laminate a magnetic circuit in which the magnetic flux changes slowly. The normal advantage obtained from laminating a flux circuit is that it reduces eddy current losses. These losses stem from the heating effect of currents which circulate in an iron magnetic circuit when the flux flow is changing at several thousand times a minute. In the magnetic separator with which the invention is concerned, the magnetic flux between the north and south poles is constant and the flux reversal in the rotor bars as they travel round the rotor axis occurs very slowly i.e. at the rate of 30 times per minute. Bearing in mind that the portion of the magnetic flux circuit through which the spacer bars pass is in any case partially air-cored one would not expect to achieve anything more than perhaps a slight reduction in power consumption by laminating the spacer bars.

Although the precise reason why the magnetic separation is improved by laminating the spacer bars is not clearly understood, it seems probable that the improvement stems from the purity of the flux circuit obtained by lamination. During the period that the spacer bars are travelling through the regions of high magnetic flux, the flux passing through the passages flanked by the spacer bars is concentrated between the opposed ribs of each pair of spacer bars as these are nearest one another. Magnetic material is attracted to the tips of the ribs where the magnetization is greatest, and can form bridges between ribs quite easily because the spacing between them is normally only a few millimeters. These bridges are thought to behave as magnetic shunts. Magnetic flux travelling between two spacer bars tends to follow the path of least reluctance which will be by way of such shunts. In consequence, the magnetic flux elsewhere in the passage is depleted and the separation of the magnetic from non-magnetic materials in the passage is reduced. The effect of laminating the spacer bars is that the magnetic flux entering one side of a lamination tends to be confined to its cross section and there is little tendency for the magnetic flux to travel between laminations in the same stack. Thus the purity of flux circuit is maintained and the formation of a magnetic shunt between the ribs of two laminated spacer bars does not result in the same amount of magnetic flux being diverted from other parts of the spacer bars. A more even distribution of magnetism over the faces of the spacer bars is thus achieved and a better separation results which improves performance by a significant percentage.

A further advantage obtained by laminating the spacer bars is that they can be produced more accurately and cheaply than is possible with a cast steel spacer bar. A cast spacer bar has to have the corrugations formed by machining. Subsequently, a considerable amount of grinding of the grooves of the corrugations is necessary to clean out extraneous metal and such grinding is expensive and time-consuming. Pieces of extraneous metal trapped in the grooves seriously impair the operation of the spacer bars by forming blockages in the grooves at times when they are to remain open so as to allow the non-magnetic material in the slurry to be washed through. By forming the spacer bars of stamped laminations, each lamination can be stamped to the exact size of its neighbour and no machining of the grooves is necessary while their cross-sectional profile is maintained throughout the height of the spacer bar. It is also easy to produce a slight inclination in the spacer bar by stacking the lamination between parallel but slightly inclined guides.

Preferably the pole pieces around the rotor are grouped in pairs of like polarity. With such a configuration, the magnetic poles past which the rotor moves still alternate with one another but the regions of low flux density are longer, when measured arcuately of the rotor, and an improved wash out of magnetic materials is obtained. Likewise, the intensity of the magnetic flux in the regions of high magnetism, which occur between pairs of poles of unlike polarity, contain a higher flux density than is the case when the polarities of the pole pieces alternate with one another around the circumference of the rotor. A better separation of non-magnetic materials from magnetic materials is therefore achieved also.

The invention will now be described in more detail, by way of example, with reference to the accompanying partly diagrammatic drawings, in which:

IN THE DRAWINGS

PREFERRED EMBODIMENT

Figure 1:
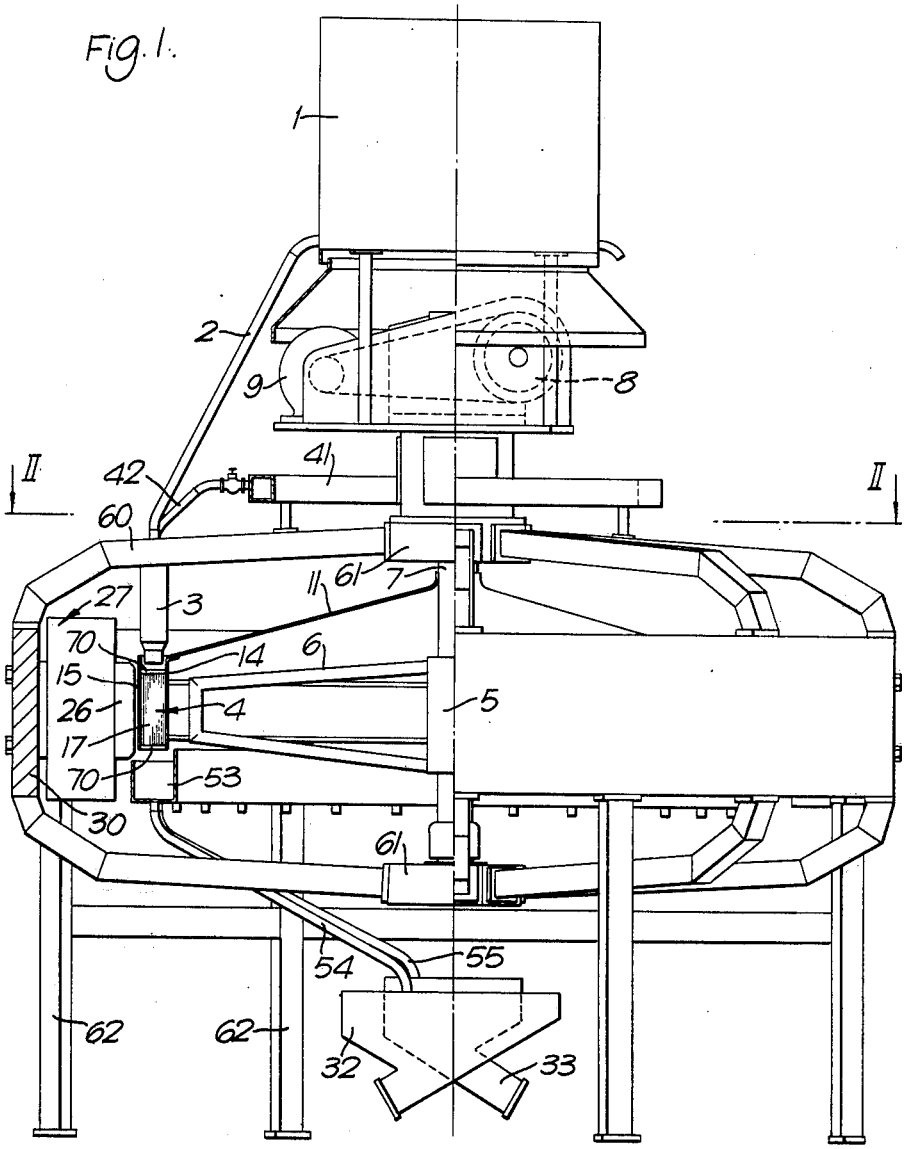
FIG. 1 shows a 16 pole high intensity wet magnetic separator in side/sectional elevation.
Figure 2:
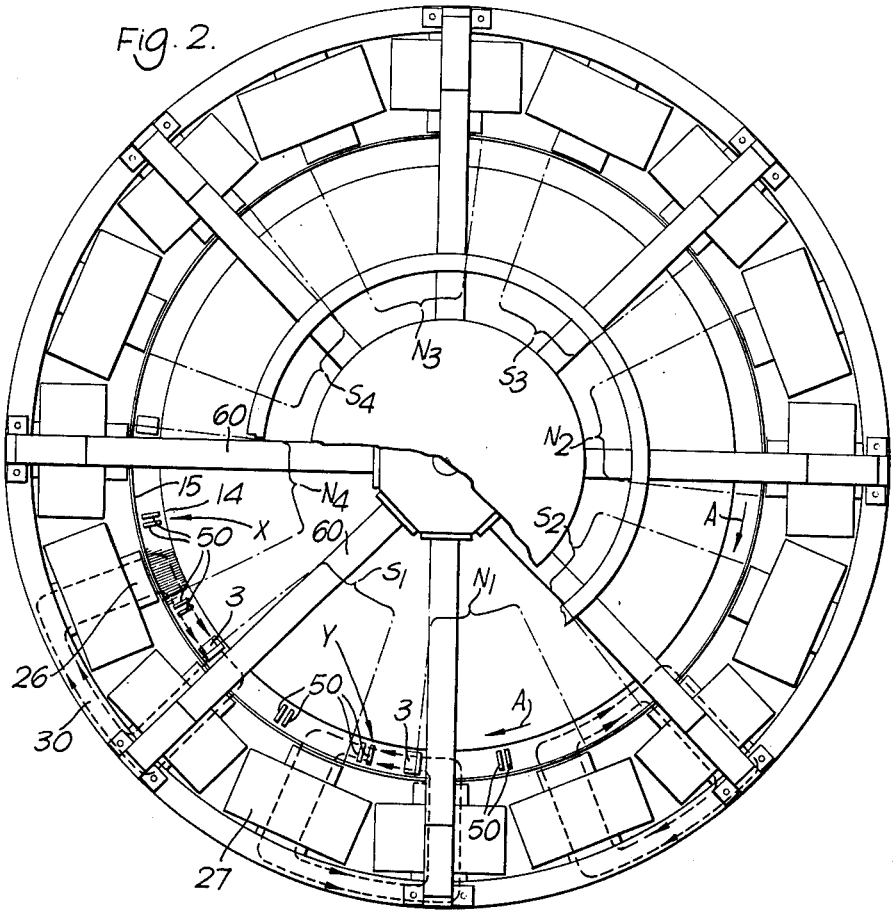
FIG. 2 is a horizontal cross-section, partly broken away, through the separator taken on the line and in the direction indicated by the arrows II—II in FIG. 1.

The separator shown in FIGS. 1 and 2 is arranged and operates in a similar manner to the separator described in the Applicant's U.S. Pat. No. 3,849,301 hereby inserted by way of reference.

Turning first to FIG. 1 the separator has a top tank 1 for containing aqueous slurry with magnetic and non-magnetic constituents which are to be separated from one another by passage through the separator. The tank 1 is provided at its underside with eight downwardly radiating outlet pipes 2 which lead into boil boxes 3 located around and above a peripheral annulus 4 on a rotor 5 having its axis arranged vertically in the centre of the apparatus.

The rotor comprises a vertical shaft 7 on which is mounted a spider 6 having radiating arms which support the annulus 4 at their extremities. The shaft 7 is rotated by a gear-reduction unit 8 mounted with an electric motor 9 directly beneath the tank 1. The shaft is rotated at about four revolutions per minute.

A frusto-conical casing 11 is arranged over the spider 6 and extends outwardly and downwardly into the mouth of the annulus 4 and is united at its peripheral edge with the top of a cylinder 14 providing the radially inner wall of the annulus 4. The cylinder 14 is made of non-magnetic stainless steel and is concentrically arranged and spaced within a second cylinder 15 also made of non-magnetic stainless steel and providing the outside wall of the annulus 4. Spanning radially between the two cylinders are spacer bars 17 which extend the full height of the annulus and divide it up into a multiplicity of upright slot-like passages which are unobstructed and open-ended. These passages are reference 20 in FIG. 3 from which it will be seen that each passage is flanked by the corrugated sides 19 of respective spacer bars 17 and its ends are provided by the respective cylinders 14 and 15. The sides of the spacer bars 17 flanking the passage are provided with opposed corrugations so that the width of the passage is not constant but varies repeatedly between a maximum width, which occurs between two opposed grooves, and a minimum width which occurs between the opposed ribs of the corrugations. The spacer bars 17, although upright, are inclined slightly from the vertical so that their lower ends trail by 9½° in the direction of movement of the rotor, which is indicated by the arrow A in FIG. 2.

Spaced around the top of the annulus 4 between the boil boxes 3 are pairs of jetting nozzles 50. These receive controllable quantities of wash water fed into them from pipes 42 which lead at their upper ends into a wash water header and manifold 41.

Aqueous slurry washed through the passages 20 of the rotor collects in a ring of outlets launders 53. Alternate launders 53 in the ring are located beneath the annulus at the positions where non-magnetic materials are washed from the passages 20. The non-magnetic materials pass from the launders through piping 54 to a drain hopper 32. The magnetic materials are washed from the passages 20 at the positions of the remaining launders 53 and these supply the materials through piping to a second hopper 33.

The outer cylinder 15 of the rotor passes close to 16 equi-angularly spaced pole pieces 26 which extend radially inwards and are bolted at their outer ends to an iron yoke 30. The pole pieces 26 have field windings which are electrically energized so that successive pairs of pole pieces have the same polarity. Thus as the rotor rotates, its periphery passes in turn eight poles ($N_1$–$N_4$, $S_1$–$S_4$) but each pole is provided by two pole pieces 26 so that the section X of the annulus lying between the two pole pieces of the same polarity has virtually no magnetic flux passed through it. On the other hand, the sections Y of the annulus passing between two pairs of pole pieces of a different polarity carries a relatively high magnetic flux which travels circumferentially of the annulus by way of the rotor bars 17. For convenience, the north and south poles in FIG. 2 are lettered $N_1$ to $N_4$ and $S_1$ to $S_4$, respectively, and the flux path of the magnetic circuit of three pairs of pole pieces 26 is shown by the arrowed broken lines in FIG. 2.

The yoke 30 is held in place by upper and lower frames 60 and rests on legs 61. The frames 60 extend inwardly above and beneath the rotor to journal bearings 61 which hold the rotor shaft 7 in place and carry the weight of the rotor and the apparatus mounted above it as shown in FIG. 1.

Each pole piece 26 is provided with an oil-cooled field winding 27 and the electrical connections to the field windings ensure that the pole pieces are magnetized with the desired polarity illustrated in FIG. 2.

Figure 4:
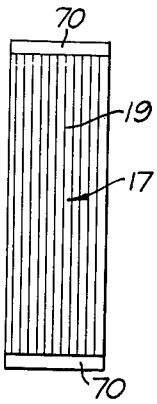
FIG. 4 is a side view of one spacer bar showing laminations.
Figure 5:
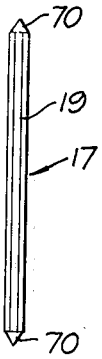
FIG. 5 is an end view of the spacer bar of FIG. 4.

The construction of one of the spacer bars 17 will now be described with reference to FIGS. 3, 4 and 5.

Figure 3:
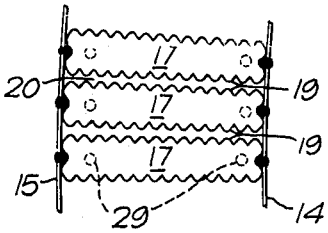
FIG. 3 is a plan view of a section of an annulus of a rotor used in the separator and which shows three radial spacer bars in the annulus.

The spacer bar is composed of a stack of laminations having the shape, in plan, shown in FIG. 3. The laminations are made from 18 gauge stainless steel plate available under the trade name "MARTENSITIC" and are stamped out of it. The sides 19 of the laminations are corrugated in identical manner and each has a shallow recess at each end. Holes 29 are provided in the end-portions of each lamination. The positions of the holes are shown in broken outline in FIG. 3. The laminations are assembled on stainless steel, non-magnetic end piece 70 of triangular cross-section as shown in FIG. 5. The laminations are stacked one above the other on top of the end piece 70 to build up the desired height of spacer bar 17. Guide rods threaded through the holes 29 in the end portions of the laminations assist their correct registration with one another. After the last lamination has been placed in position a top, stainless steel, non-magnetic end piece 70 is fitted to the top of the stack after removal of the alignment rods and then the grooves at the two ends of the spacer bars, formed by the aligned shallow recesses of the laminations, are filled with weldment. This locks the laminations to one another and to the end pieces 70 to form a spacer bar of unitary construction having vertical corrugations on its sides as shown in FIG. 4.

The laminated spacer bar 17 is mounted in position during the construction of the rotor and after surplus weldment at the two ends of the spacer bar 17 has been removed by machining. The spacer bars 17 are positioned with their radially inner ends against the outside surface of the stainless steel cylinder 14 which has been preformed with upright rows of holes. The inner end of one spacer bar is aligned with each upright row of holes and the the holes are then plug-welded so that the weldment of the bars is united by the plug welding with the cylinder 14. The spacer bar's width increases slightly from its radially inner end to its radially outer end so that the minimum width between a pair of spacer bars 17 is the same at the inner end-portions of the passages 20 as it is at the radially outer end-portions of the passages 20.

The assembly of the rotor is completed by arranging the outer cylinder 15 around the outer end of the spacer bars 17. The cylinder 15 is also preformed with upright rows of holes so arranged that each overlaps the position of one of the spacer bars. The cylinder 15 is then plug-welded to the spacer bars through the holes so that the laminations of the bars are welded to one another and to both cylinders to provide a strong durable rotor assembly.

OPERATION OF PREFERRED EMBODIMENT

During operation of the separator the rotor is rotated at about four revolutions per minute. The annulus therefore undergoes 32 flux reversals per minute. The passages 20 pass in turn beneath the boil boxes 3 and the wash water nozzles 50. As is clearly shown in FIG. 2, the boil boxes 3 are positioned to discharge slurry into the annulus 4 just as the passages 20 passing beneath the boil box 3 are entering the zone of maximum flux intensity in the direction of movement of the passages 20. This occurs between north pole $N_1$ and south pole $S_1$.

The slurry travels downwardly through the passages 20 and the flux intensity is such that its effect on the laminated spacer bars 17 causes their opposite faces 19 to assume opposite magnetic polarities. The magnetism tends to be concentrated at the points where the sides of the passages are nearest one another and magnetic material in the slurry is attracted and held to the ribs of the corrugations at these positions. In contrast, the grooves of the corrugations are only weakly magnetized so that the slurry with the non-magnetic material intrained in it washes through the grooves of the corrugations while the magnetic materials are held to the opposed ribs of the corrugations. Inevitably some bridging between the peaks of the corrugations occurs. However, because the rotor bars are laminated, there is little tendency for the magnetic shunts, formed by such bridging, to divert flux towards them from other parts of the spacer bars 17. A more uniform distribution of the magnetic field across the sides of the passage 20 therefore results and the separation of magnetic from non-magnetic material achieved is substantially greater than is the case when non-laminated rotor bars are used.

The launders 53 which collect the non-magnetic materials are located beneath the regions of high magnetic field in the rotor and the slight trailing orientation of the passages 20 compensates for the angular movement of the passage which occurs during the flow through it of the slurry from the boil boxes 3. The flow of non-magnetics from the passages 20 is assisted by additional wash water provided by a pair of the nozzles 50.

As the passages 20 leave the region of high magnetic intensity, they enter a region of zero magnetic intensity which occurs between two pole pieces 26 of like polarity. The magnetic flux travelling in the direction of movement of the passages 20 is zero at this point X and a pair of wash water nozzles 50 is located between the positions of the pole pieces 26 of each pair and washes the magnetic materials from the passages 20 from which the non-magnetic materials have already been washed. The wash water with the magnetic materials is collected in one of the launders 53 and fed into the magnetic material hopper 33.

The passage 20 next passes beneath another boil box 3 and the sequence is repeated eight times during each revolution of the rotor.

If desired the magnetic and non-magnetic materials separated from one another by passage through the separator may be recycled through the same separator or other separators to increase their purity.

From experiments carried out it appears that the advantages obtained by laminating the spacer bars are that the separation ability of the machine is enhanced for the same consumption of power as compared with a machine having conventional cast steel rotor bars. As explained above, this is believed to stem from the reduction in the adverse affects of magnetic shunting in the passages between the spacer bars so that a purer and more uniform flux distribution between the ribs of the corrugations of the passages is obtained. Secondary advantages achieved are that machining of the corrugations is not necessary and the bars can be constructed more cheaply, in consequence, and with less risk of unwanted metal pieces being trapped in the spacer bars grooves. Also, by using stampings, corrugations of optimum cross-section can be formed more easily than is the case when machining. Furthermore the performance of the machine can be improved without increasing its manufacturing costs. Finally, there is some small inevitable saving achieved by laminating the rotor bars as a result of the reduction in eddy currents in them and which represent a small power wastage. In this regard it will be noticed that, unlike conventional machine laminations, the laminations are welded to one another at their ends so there is a path for eddy currents to flow between them. In practice, the rate of change of field in the rotor as it rotates is so small, bearing in mind that the magnetic flux reverses at rather less than once a second, that the slight saving obtained in power consumption by reducing eddy current circulation would not justify laminating the rotor bars on the same grounds as laminating magnetic circuits of machines undergoing flux changes at 50 times a second.

Although the machine described has the rotor bars built up by laminating in the horizontal direction, it is believed that an improved performance would also be obtained were the laminations to be arranged vertically rather than horizontally.

The separator described has an overall diameter of 8 ft. and an overall height of 10 ft.

I claim:

1. A magnetic separator comprising:

a. a magnetically impermeable rotor mounted on a vertically oriented shaft and having at least one annulus constituting or formed on its periphery and defined by spaced-apart walls, the walls being formed from a material having non-magnetic characteristics, and the at least one annulus being disposed about the axis of rotation of the rotor, b. a number of spacer bars of a magnetically permeable material extending in a radial direction between the walls of the annulus successive spacer bars together with the annulus walls defining through passages into which magnetic particles in a liquid slurry may be fed to pass in a direction substantially parallel to the axis of the rotor said spacer bars being of laminated construction with the planes of the laminations extending in the direction of rotation of the spacer bars, c. a number of magnetic pole pieces surrounding the rotor and having their magnetic axes disposed radially with respect to the rotor said pole pieces providing successive radial magnetic pole regions of opposite polarity around the rotor whereby a magnetic field of maximum intensity is induced in the spacer bars intermediate successive ones of the magnetic pole regions, d. means for feeding the slurry into the top ends of said passages adjacent the magnetic pole regions, e. a plurality of first means above the respective pole regions for delivering a washing fluid into the top ends of said passages for washing magnetic particles from within the passages, f. a plurality of second means for delivering a washing fluid into the top ends of said passages for washing non-magnetic particles from within the passages, said second means being disposed above top end of said annulus and circumferentially between said first means, and, separate means for collection of magnetic and non-magnetic particles which are washed from the bottom ends of said passages.

2. A magnetic separator as claimed in claim 1 wherein the laminations lie in horizontal planes.

3. A magnetic separator as claimed in claim 2, wherein the top and bottom of each spacer bar is provided with a non-magnetic element of tapering cross-section to provide flared top entries for the passages and bottom outlets which assist clean release of magnetic particles from the spacer bars.

4. A magnetic separator as claimed in claim 2, wherein the laminations are welded to one another at their radially inner ends and at their radially outer ends.

5. A magnetic separator as claimed in claim 2, wherein said walls of said annulus comprise concentrically arranged stainless steel non-magnetic cylinders and said spacer bar laminations have their radially inner end welded to one another which is also welded to the inner one of said cylinders and their radially outer ends welded to one another which is also welded to the outer one of said cylinders.

6. A magnetic separator as claimed in claim 2, wherein each of said magnetic pole regions is provided by a pair of neighboring pole pieces of like polarity whereby the separator has a ring of equi-spaced, radially directed magnetic poles which are paired to provide pairs of poles of north magnetic polarity which alternate with pairs of poles of south magnetic polarity.

7. A magnetic separator as claimed in claim 2, wherein said slurry feeding means are located above and between said magnetic pole regions at positions where the passages of the rotor pass beneath the slurry feeding means before passing beneath said second means.

8. A magnetic separator as claimed in claim 2, wherein the number of said radial magnetic pole regions is a whole number multiple greater than one of the number of magnetic pole pieces, and said magnetic pole regions each provide a magnetic flux whose intensity varies across said region whereby the radial magnetic flux is a maximum at the two sides of the said region and a minimum at the centre of said region.

* * * * *